US007039969B2

(12) United States Patent
Zorzo

(10) Patent No.: US 7,039,969 B2
(45) Date of Patent: May 9, 2006

(54) MOP BASE FOR MOP PADS WITH POCKETS

(75) Inventor: Roberto Zorzo, Onara (IT)

(73) Assignee: Filmop s.r.l., Onara di Tombolo PD (IT)

( * ) Notice: Subject to any disclaimer, the term of this patent is extended or adjusted under 35 U.S.C. 154(b) by 360 days.

(21) Appl. No.: 10/113,367

(22) Filed: Mar. 29, 2002

(65) Prior Publication Data

US 2002/0152569 A1 Oct. 24, 2002

(30) Foreign Application Priority Data

Nov. 19, 2001 (IT) ..... PD2001A0074
Nov. 19, 2001 (IT) ..... PD2001A0210

(51) Int. Cl.
*A47L 13/20* (2006.01)

(52) U.S. Cl. ..... 5/147.1; 15/150; 15/229.1; 15/231; 15/233

(58) Field of Classification Search ..... 15/231, 15/233, 147.1, 150, 229.1
See application file for complete search history.

(56) References Cited

U.S. PATENT DOCUMENTS 6,687,943 B1 * 2/2004 Zorzo ..... 15/228
2001/0013153 A1 8/2001 Zorzo ..... 15/247

FOREIGN PATENT DOCUMENTS

DE 295 19 320 U1 3/1996

OTHER PUBLICATIONS

European Search Report dated Dec. 3, 2002.

* cited by examiner

*Primary Examiner*—Richard Crispino
*Assistant Examiner*—Abraham Bahta
(74) *Attorney, Agent, or Firm*—Marshall, Gerstein & Borun LLP

(57) ABSTRACT

The invention provides a mop for mop pads with pockets having an articulated mop base with elements centrally connected to a handle by means of a hinge joint, a mop pad with pockets, and a clamping device provided near the free end of a first element, with the mouth of the clamping device directed towards the free end, and an extension provided at a second element and being placed on top of the lever of the clamping device when the mop base has a planar shape.

17 Claims, 14 Drawing Sheets

MOP BASE FOR MOP PADS WITH POCKETS

BACKGROUND OF THE INVENTION

1. Field of the Invention

The present invention relates to cleaning devices, in particular to mops with a base made from jointed boards suited for mop pads with pocket.

2. Related Technolgy

In the field of cleaning, brooms with an active surface constituted of mop pads supported by a mop base are well known.

The variety of mop pads is substantial both for the kind of material and as for their structure because they need to be combined with the mop bases.

At the same way, the variety of mop bases is substantial because they need to support the stretched active surface of the mop pad.

The problem, which is related to the generic active surface of the mop pad and of the mop base supporting such active surface, involves several phases: the assembly of the mop pad on the mop base, its correct stretching, the guarantee of the maintenance of the combination of the mop base and of the mop pad during the movement for the cleaning of the floors, the separation of the mop pad to be washed and replaced.

The mop bases, which are supplied at the top with handles by a hinge joint system, can therefore be carried out only in one piece, in two or even in more pieces articulated to each other by hinges.

These mop bases are supplied with devices usually controlled by buttons to be operated by a user's foot in order to provide a quick and easy possibility to change the mop base shape from a planar to an angled shape and vice versa. The ends of these mop bases have usually a tapered thickness and can be equipped of clamps properly assembled and shaped in order to hold the mop pads which are supplied at their ends with suitable appendages.

The mop pads, which can be made in textile or in other useful materials for cleaning, must be properly shaped according to the kind of combination with the mop bases which must support them.

The mop pads can be equipped of appendages or flaps at the ends.

These flaps can be made of a basically stiff or flexible material; they can have a pre-defined inward orientation or they can be in alignment with the level of the mop pad; they can be supplied with an eyelet or not. In case of use of these types of mop pads, the mop bases must be provided at their ends with suitable clamps or hooks in order to support and secure such mops during operation.

In alternative, in presence of appendages or flaps, the mop pads can be provided at their ends of suitable pockets on the surface opposite to that of the usable board.

In case of use of these kinds of mop pads provided with pockets, the mop bases, which must support them, show their ends without clamps or holds.

In the two cases above mentioned, the assembly and disassembly of a mop pad, on a mop base provided with appendages (or of flaps) or pockets, are carried out in a quite different way.

Precisely:

in case of mop pad provided with flaps or appendages, the phases of assembly are as follows. The mop pad is laid out on the floor level and the mop base is angled by putting it on the mop pad. A clamping device is opened at one end of the mop base and then one of the two appendages (or flaps) is inserted. A clamping device is closed. Then a clamping device of the mop base is opened at the opposite end and the other mop pad's appendage (or flap) is inserted. The handle is lowered by placing the mop base against the floor and if it is necessary by pressing with the foot on the suitable rise on the flat level of the mop base till the suitable block nib is hooked. The mop base is in planar position stretching at the same time the applied mop pad.

As regards the clamps which are driven by springs, it must be clarified that if the same clamps, being at rest, are biased in a clamping position by the springs, the above mentioned closing operation consists in stopping the counteraction practised at the beginning by the springs which kept the clamps closed.

The phases of disassembly of the mop pad from the mop base are carried out in the sequence opposed to the one of assembly.

The broom has to be kept in hold with the mop pad on the floor, a pressure must be exerted with the foot on the latch placed on the surface of the mop base in order to release the block nib.

By raising up the handle, the different parts of the mop base take an angled direction. In this position of an angled mop base with the mop pad hanging down, without separating the mop pad from the mop base, the mop pad can be washed by raising up the whole device and putting it in a washing tank and then inside a suitable wringer.

In order to separate the mop pad from the mop base, with the latter one in angled shape, the operation must be performed on each of the clamps end by opening them and taking the appendages (or flaps) off:

in case of mop pad supplied with pockets on the surface opposite to the active surface, the phases of assembly are carried out as follow;

The mop pad is stretched on the floor level and the mop base is made angled putting it on the mop pad in central position.

The handle is gradually lowered towards the floor so that the ends of the mop base, creeping on the mop pad, take by degrees an ever more enlarged shape till the pockets' mouths are reached. Going on with the lowering of the handle, the ends of the mop base are inserted completely into the pockets. At this point, the shape of the mop base is almost planar. To carry out the lowering of the handle, which is linked to the mop base against the floor, it is necessary to press even with the foot on the suitable rise on the flat level of the mop base till the suitable block nib is hooked. The mop base is in planar position stretching at the same time the applied mop pad.

The disassembly phases of the mop pad from the mop base are carried out in the sequence opposed to that of assembly.

The broom kept in hold on the floor, it must be made a pressure with the foot on the latch placed on the surface of the mop base so as to release the block nib; by raising up the handle, the different parts begin to take an angled position. Taking an ever more angled position the ends of the mop base come out from the pockets releasing themselves from the mop pad which is left on the floor level. The mop pad must necessarily be taken with the hands and raised up in order to be put in a washing tank and then in a wringer so as to be wrung or to be put in a suitable case for an overall washing by a washing machine together with other mop pads of previous uses.

When it comes to gather the mop pads left on the floor level, the operator must bend putting under pressure his or her back and consequently stressing the spine. If this operation is repeated several times (fifty or one hundred times ) during the day the problems become serious.

This causes a weakening for the operator who, with the passing of time, can suffer a disablement of his or her physical abilities (backache, arthritis on the vertebrae of the spine and the appearance of slipped discs).

It must be clarified that, for those cleaning which imply not only a simple washing but rather the disinfecting of the rooms, as it is demanded in the hospital wards, the use of mop pads with pockets has become almost exclusive.

SUMMARY OF THE INVENTION

It is therefore an object of the present invention to provide a mop base for mop pads with pockets which allows an operator to exchange a mop pad without being required to bend down for picking up the mop pad left on the floor.

The above object is achieved in particular by a mop base for mop pads with pockets, comprising two or more elements, and providing a clamping device pivoted on a first element of the mop base with its mouth kept open by interference of a second element of the mop base with a lever of the clamping device opposite the mouth of the clamping device.

Further, the above object is achieved by a mop for mop pads with pockets comprising an articulated mop base according to the present invention, with elements centrally connected to a handle by means of a hinge joint, and a mop pad with pockets, whereby a clamping device is provided near the free end of a first element with the mouth of the clamping device directed towards said free end, and an extension is provided at the second element which is placed on top of the lever of the clamping device when the mop base is in straight position.

A mop with a mop base according to the present invention allows a user to replace a mop pad with pockets fast and easy, and without any need for bending down.

The mouth of the clamping device is preferably in its position of rest closed in a clamping position, when the lever opposed to the mouth is not pressed by the extensions of an element of the mop base provided with a latch, thus allowing to control the clamping fixture with the second element of the mop base.

Advantageously, the mouth of the clamping device is in its open position when the lever of the clamping device opposed to the mouth is pressed against the spring by the extensions of element of the mop base provided with the latch, so that the clamping mechanism can return in its other state by itself when being released.

For a mop base being in straight position the mouth of the clamping device its further advantageously open, resulting in the opposed lever being lowered by the action of the extensions of an element provided with a latch. This allows a pocket of a mop pad to automatically slip in the mouth provided by the clamping device giving the mop bad a safe support.

The mouth of the clamping device is preferably closed when the elements of a mop base are in an angled position, resulting in the extensions of the second element opposed to the one provided with the clamping device pulled aside from the lever which activates the mouth of the clamping device. Thus, when the mop base is ready to be taken from the mop pad, the clamping device will still clamp the mop pad on one side to allow an user pull it from the mop base in midair.

The clamping hold of the mouth of the clamping device is further advantageously soft enough to allow an easy slipping of the outside part of the pocket of the mop pad from the mop base effected by the operator when the mop base is raised up with its elements in an angled shape and the mop pad is hanging down.

The shape of a clamping device, which is driven to be with its mouth open when the elements of the mop base are in straight position, preferably allows the insertion of the free end of the first element of the mop base provided with a clamping device in a pocket of the mop pad stretched on a floor without interfering in the specific operation of insertion.

A clamping device is further preferably closed in a position for clamping the outside surface of the pocket of the mop pad during the following phases for the completion of the assembly of the mop base in the pockets of the mop pad with the elements (of the mop base) in angled position allowing a completion of the phase of insertion of the free end of the opposed element of the mop base in the free pocket of the mop.

When changing from the straight position of the mop base with its free ends engaged in the pockets of the mop pad to the angled position, and having deactivated the block nib by pressing the latch by foot, the clamping device closing itself advantageously by taking in its position of rest thereby automatically clamping the wall of the pocket which was kept in the mouth, so that the mop pad is hanging down from a pocket allowing an operator to take the mop pad by simply stripping it from the clamping device without bending.

In a further preferred embodiment of the present invention, a lever like arm is integrated in a latch used to unblock the elements of a mop base in straight position, thereby advantageously combining two functions in one add-on.

The lever like arm of a clamping device further preferably shows the front border raised in a curvilinear shape, in order to facilitate a first entryway for an edge of a pocket of a mop pad below the clamping device.

In a further advantageous development, the lever like arm of a clamping device shows an appendage rather moved inwards compared to the front border coming down from its lower surface and properly inclined towards the insertion of the edge of a pocket of a mop pad to present a mouth for the insertion of a pocket of a mop pad and a means for clamping the mop pad when being removed from the mop base.

The appendage extending down from the lower surface of the lever like arm of a clamping device has preferably such an inclination and shaping that, after the forcing of the way in of the edge of a pocket of a mop pad, it advantageously moves away from the supporting plane on the mop base raising the lever like arm (counteracting the elastic force which keeps it pressed) enough to make the edge of the pocket of the mop pad pass.

The appendage extending down from the lower surface of the lever like arm has preferably such an inclination and shaping that it can sustain the weight of a mop pad even when it is soaked of liquid when the mop pad is hanging down clamped by the lever like arm, thus assuring that the mop pad can always be removed in midair.

The appendage extending down from the lower surface of the lever like arm is further preferably inclined and shaped in a way, that when it keeps the mop pad hanging down it can let the hold it exerts on the mop go after a moderate traction of the mop pad from the operator.

An appendage extending down from the lower surface of the lever like arm of the clamping device, with said appendage combined to the lower surface of said lever like arm by a hinge is advantageously designed being capable of inclining itself towards the direction of the insertion of the edge of the pocket of a mop pad to let this edge pass under the lever like arm and to give a proper resistance if stressed in the opposite direction.

A flexibly pliable appendage further preferably extends down from the lower surface of the lever like arm, with said appendage being capable of inclining itself towards the direction of the insertion of the edge of a pocket of a mop pad under the lever like arm to let this edge pass and to give a proper resistance if stressed in the opposite direction.

Mops as well as brooms with a mop base according to the present invention can e.g. be used for commercial and industrial cleaning purposes or the like, in particular the can be used for disinfection purposes in hospitals. Mops according to the present invention are further suited for a use in private homes to unburden a homemakers life.

BRIEF DESCRIPTION OF THE DRAWINGS

In the following description, the present invention is explained in more detail with respect to special embodiments and in relation to the enclosed drawings, in which.

DETAILED DESCRIPTION

Figure 1:
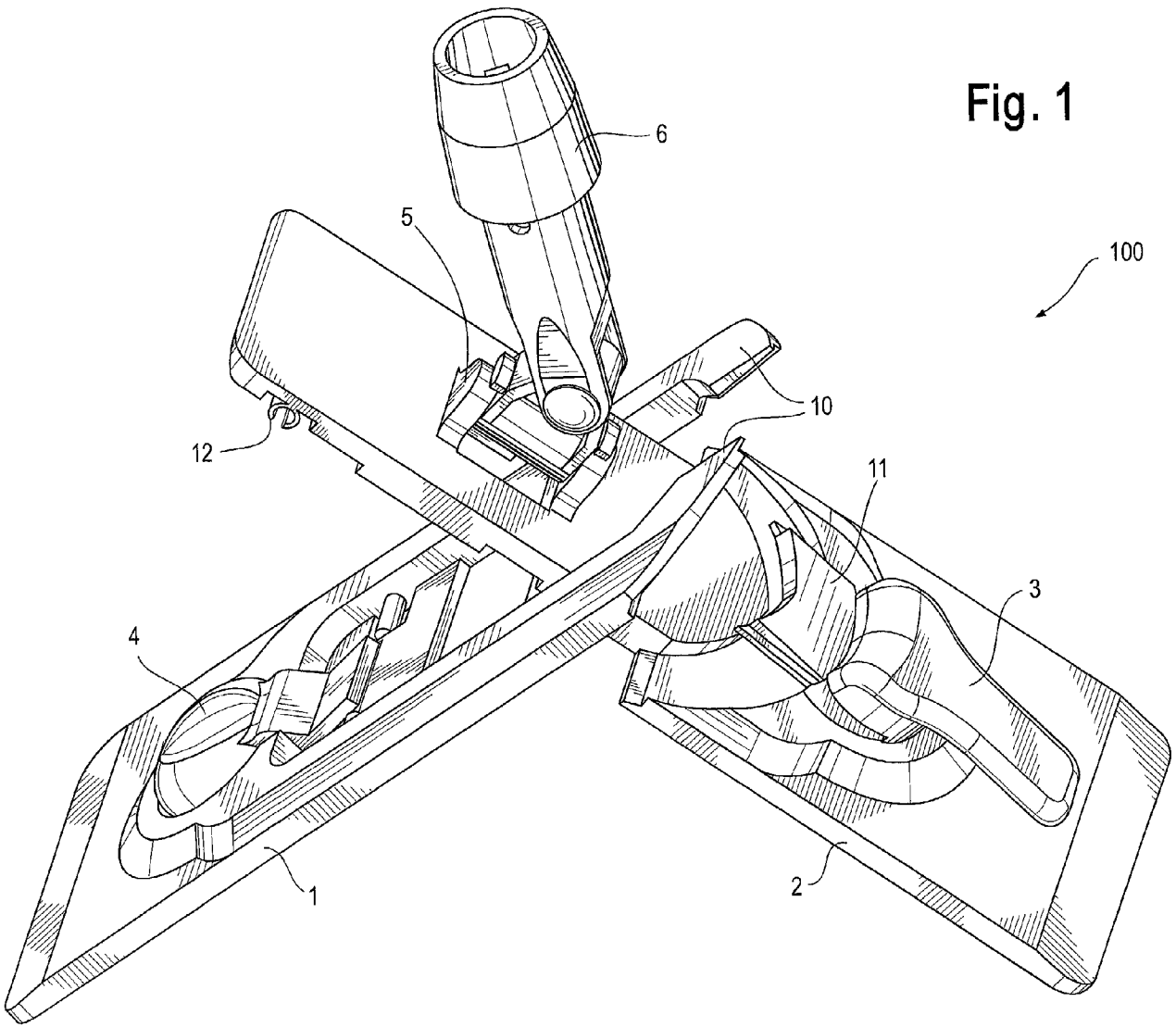
FIG. 1 shows a first embodiment of a mop base according to the present invention in an axonometric representation.

The components of a mop base 100 according to the present invention are explained with reference to FIG. 1. The mop base 100 is basically formed of two parts, a first element 2 and a second element 1. The first element 2 is a board made e.g. from a polymer, metal, wood or the like with a substantially plane surface on the bottom side, which is the side not visible in the representation of FIG. 1. The board forming the second element 1 can either be made from the same material than the board of the first element 2, but may also be made from a material different to those mentioned above, particularly when an aesthetic effect is to be achieved.

The first element 2 is jointed to the first element 1 by a pivot not shown in the representation. The pivot enables a defined tilting of the first element with respect to the second element by enabling a rotation around a common axis formed by the pivots central axis. The pivot can be formed by an axle-like object but also by special shaping of the two boards forming element 1 and 2 at the position of the rotation axis.

A pivot can e.g. be formed by protrusions on one element fitting in a substantially complementary formed indentation on the other element. As two faces of the boards of element 1 and element 2 face each other at the pivot joint, each element may have a protrusion on one face and an indentation on the other. The pivot can for instance be formed alternatively by a rod which is fixedly mounted to one element enabling the other element to rotate around it freely, or by a two-piece rod the parts of which are combined with a screw or a snap-in connection or the like.

Figure 3:
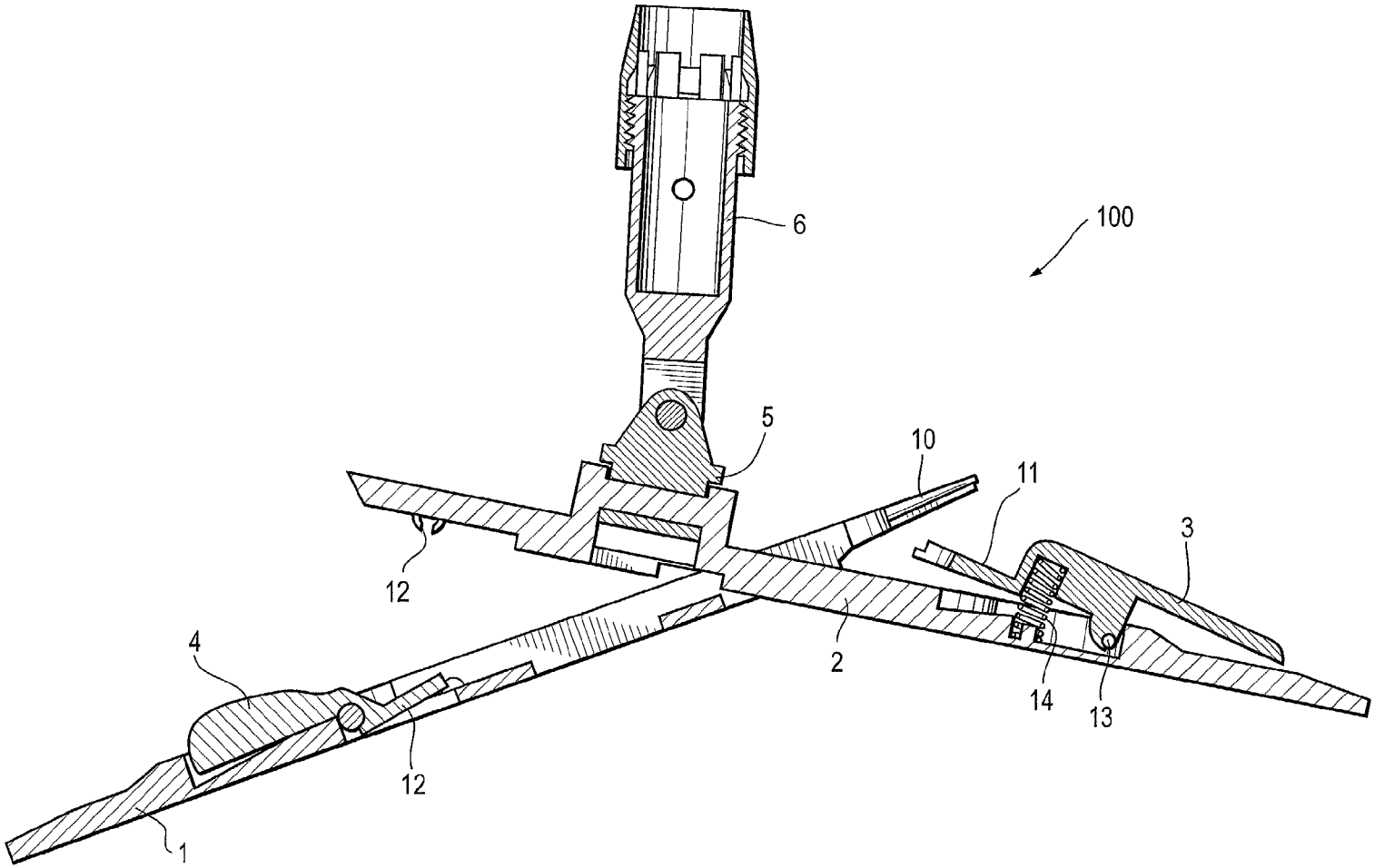
FIG. 3 shows a cross sectional representation of a first embodiment of the present invention with the boards of the mop base in a tilted position.
Figure 4:
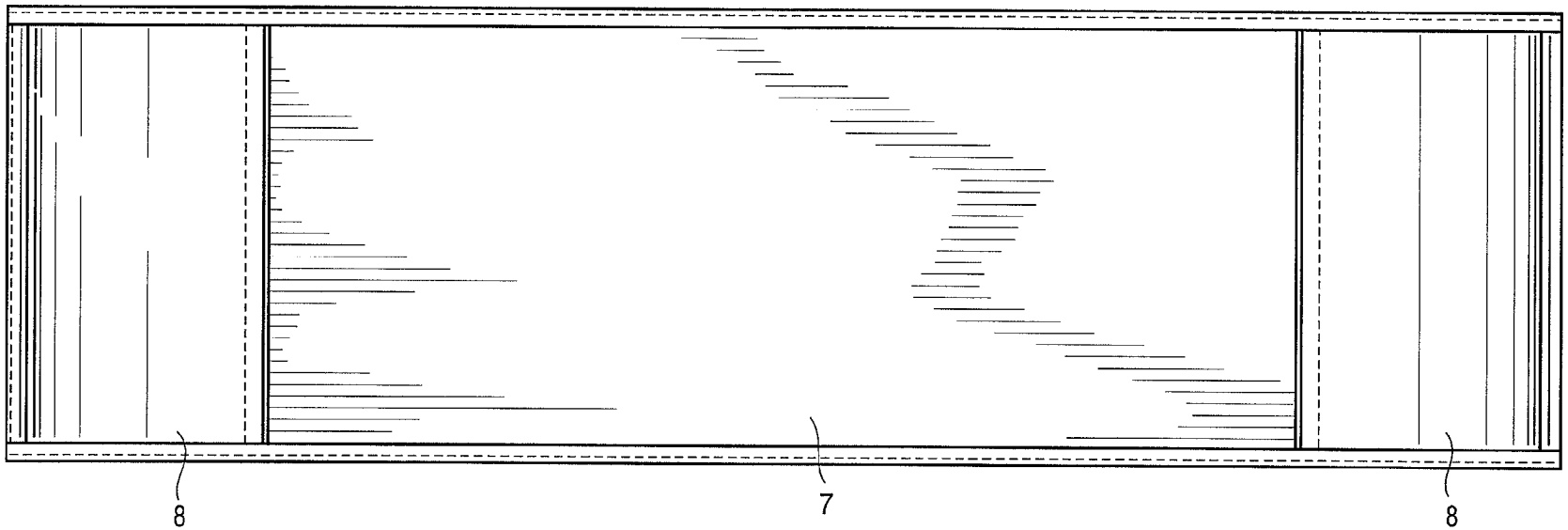
FIG. 4 shows a schematic top view of a mop pad with pockets.

The tilt axis formed by the pivot is required for enabling to change the state of the mop base 100 from a first state representing a straight position with the bottom surfaces of the elements 1 and 2 combined to one uniform and planar surface defining the mounting surface for a mop pad 7, and a second state characterized by the two boards 1 and 2 being in a configuration angular to each other for inserting the mop base 100 in a mop pad 7 with pockets 8 shown in FIGS. 3 and 4, or for removing it from a respective mop pad 7. The second state of the mop board 100 is also referred to as its angled position. The ends of boards 1 or 2 forming the small faces of the combined boards will, in analogy to an arm of a swivel mechanism be further denoted as a free end of a board, and the elements 1 and 2 will also be referred to as the arms of mop base 100. Further, the second state of the mop base 100 is in this context also referred to as the mop base' angled shape.

Each of the elements 1 and 2 extends partially beyond the common tilt axis. These extension are used as control elements having an impact on the status of add-ons 4 and 3 attached to the top surfaces of elements 1 and 2. Both extensions are substantially formed complementary to each other, with the extension of the second element I fitting in a respective recess of the first element 2 and vice versa with the extension of element 2 fitting in a respective recess of element 1 when the base board is brought to its first state represented in FIG. 2.

A link or hinge joint 5, respectively, connects a pole receptacle 6 with the top surface of element 1 or 2. The pole receptacle is also referred to as handle 6 in this specification. The link joint comprises two rotation axes arranged perpendicular to each other. The two axes enable to tilt the pole in all directions off from the normal of the top surface of the mop base 100. The link joint 5 is preferably constructed for being snapped-on a pivot like elevation on the top surface of the respective element 1 or 2. In a preferred embodiment of the present invention, the link joint 5 is provided close to the geometrical centre of the mop base 100 in its first state and in close vicinity to the tilt axis of the two elements 1 and 2.

The boards of elements 1 and 2 are interlocked to form the above described first state of the mop base 100 by a latch mechanism provided by a latch 4 attached to the board of the second element 1. A first lever is formed on latch 4 which is located in a certain part of the recess in the second element 1 matching the extension of the first element 2 when the latch 4 is mounted on the mop base 100. The second lever of latch 4, located on its end opposite the first lever is shaped button or knob like with a large enough surface to be easily pressed down by foot or hand. A clamp-like feature located at the transition from the first to the second lever forms a snap-to guide, enabling latch 4 to be attached to a respective pivot structure located on the second element 1 to form a tilt axis for the latch around the pivots central axis.

A block nib 12 is provided for securely interlocking the first with the second element. The block nib 12 is formed of clips and rod like structures located on element 1 and element 2. When the both elements are tilted to bring the mop base into its planar first state, the boards of elements 1 and 2 are tightly fixed together by clips 12 snapping on suitable rod like structures 12 on the respective other element. The clips 12 are either formed on just one of the boards of element 1 and 2 with the rod like structures 12 on the other, or each of the boards is similarly equipped with both, clips and rods.

For an alternative embodiment of a block nib, the respective end of the extension of element 2 is suitably formed to fit in a grove formed on the latch when the boards of the mop base 100 are tilted to form the first state. The first lever of the latch hereby has a curvilinear shape giving it a spring like elasticity to push the extension of the first element 2 out of the respective recess of element 1 when the button or knob like lever is pressed.

A clamping device 3 is attached to the first element 2 as a second add-on to the mop base 100. It has to be noted that the order, in which the add-ons 4 and 3 are laid out on elements 1 and 2 as shown in FIG. 1, is to a certain extent chosen arbitrarily. The positions for the latch 4 and the clamping device 3 are in fact exchangeable.

The clamping device 3, the top surface of the first element 2, and one or more compression springs 14 form together a clamping fixture. The design of the clamping fixture is shown in FIG. 3. The clamping device 3 can be tilted around the central axis of a rod like element 13 formed on the first element 2, when being fixed to it with the clam like snap on projection formed at its lower central part. The clamping device 3 has a lever like arm extending in direction of the free end of the first element 2 for a mounted clamping device 3. A further lever 11 is provided at the opposite end. A compression spring 14 biases the tilt position of the clamping device 3 when no force is exerted on the lever 11 such, that the lever like arm tilts to the top surface of the first element.

Figure 2:
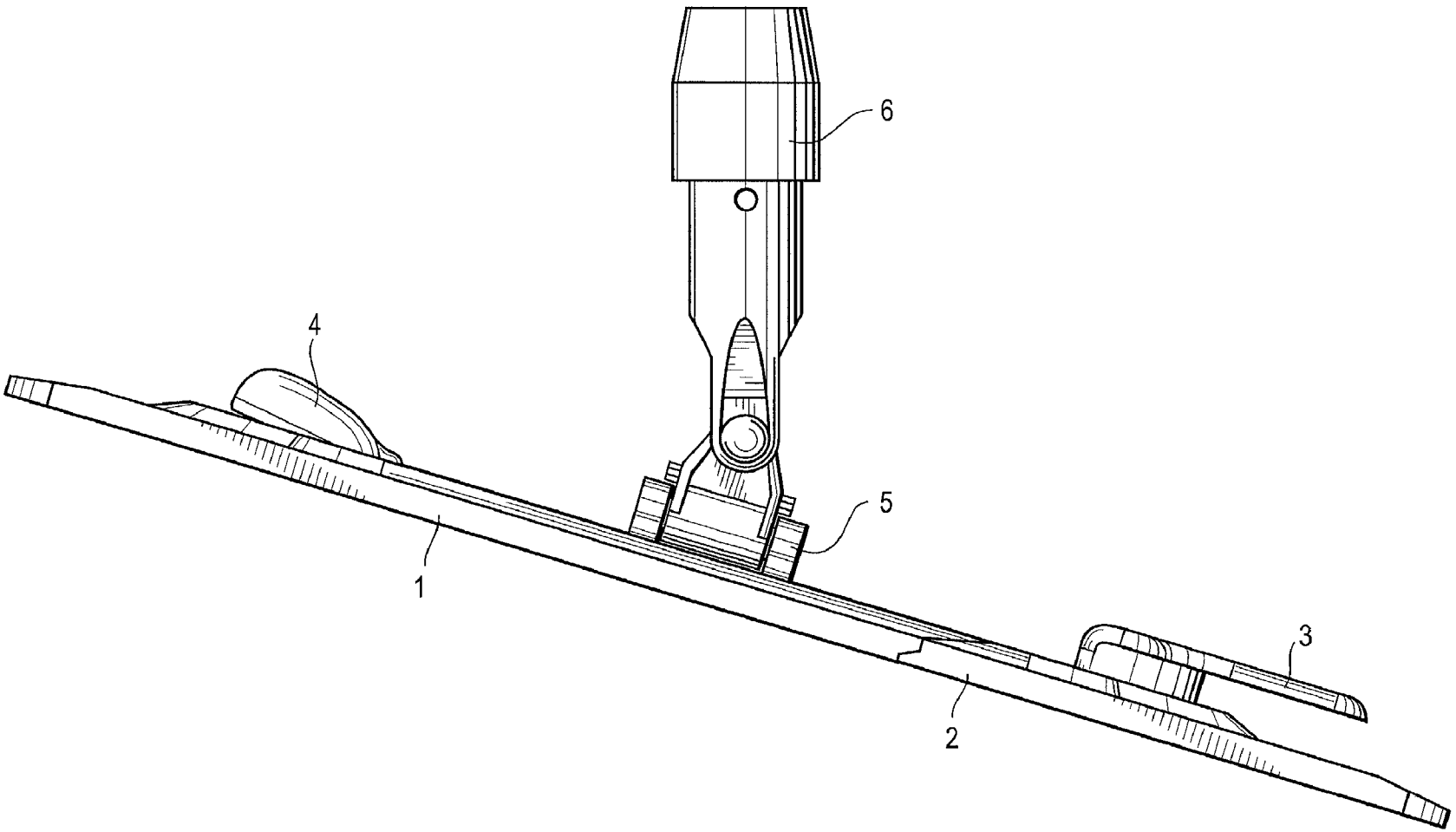
FIG. 2 shows a side view of a first embodiment of a mop base according to the present invention.

When the boards of element 1 and 2 are tilted back to form a mop base 100 in its first state with the bottoms of the boards of element 1 and 2 combined to a planar, uniform surface, the extension 10 of the second element 1 is lowered in the complementary recess of element 2 which also hosts the lever 11 of the clamping device 3. The extension 10 or part of it thereby presses the lever 11 of the clamping device down towards the bottom side of the mop base 100. This lifts the lever like arm of the clamping device 3 from the top surface of element 2 resulting in a mouth like opening as shown in FIG. 2. In the following, the mouth like opening formed between the lever like arm of the clamping device 3 and the top surface of the board of element 2 will simply be referred to as mouth.

In an alternative embodiment of the present invention, the clamping device 3 is integrated in a combination add-on together with the latch 4. This combination add-on is e.g. located on the second element 1 as the latch of the embodiment described above. Different from above, the first lever of this latch is not formed by a knob or button like structure, but takes the form of a lever like arm resulting in a provision of a clamping device 3. Thus, by pressing on the lever like arm, the mop base will take in its angled shape, and the lever like arm will tilt to the surface of the second element clamping a mop pad 7 if present.

The idea behind the present invention consists of providing a mop base 100 (the jointed type) with a clamping device 3 applied near the free end of an element 1 or 2 of the mop base 100 with the mouth turned towards this free end.

With the elements 1 or 2 of the mop base 100 in planar shape, the clamping device 3 is kept with its mouth open. This happens thanks to a further extension 10 of element 1, which exceeds the tilt axis of the mop base 100, and which is opposed to the part of element 1, which carries the latch 4.

With the mop base 100 in planar shape, this further extension 10 keeps the lever 11 of clamping device 11 pressed against the flat level of the mop base 100; thereby counteracting the pressure exerted from spring 14. Lever 11 is opposed to the mouth defined above.

With the mop base 100 in tilted position, the above mentioned extension 10 is spaced out from the clamping devices lever arm 11 previously pressed; for this reason, one of the clamping fixtures spring 14, which is no more contrasted, makes the lever arm raise and a clamping device 3 mouth places itself in closing position.

Figure 5:
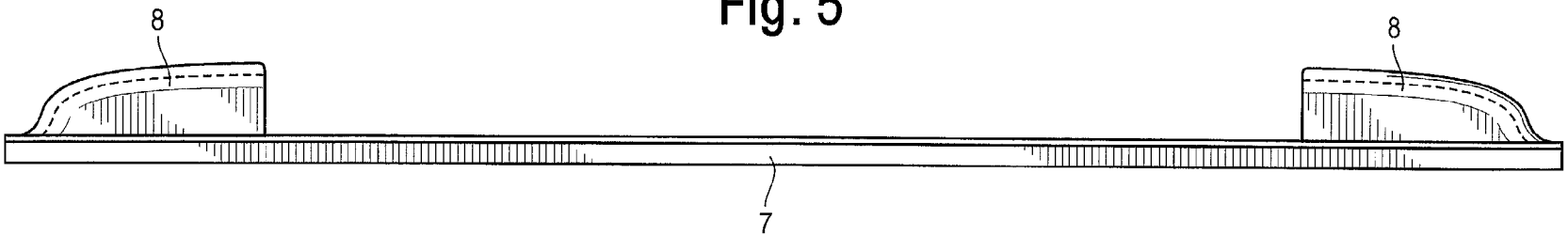
FIG. 5 shows a schematic side view of a mop pad with pockets.

The mop base 100 together with a mounted mop pad 7 forms a mop according to the present invention. A respective mop pad 7 is shown in FIG. 4. The mop pad has a substantially rectangular circumference with a pocket element attached on each of the small ends of the rectangle to form a pocket 8 as shown in FIG. 5. The mop pad is preferably made from a textile material like e.g. a terry cloth, a micro fibre cloth or the like.

Figure 6:
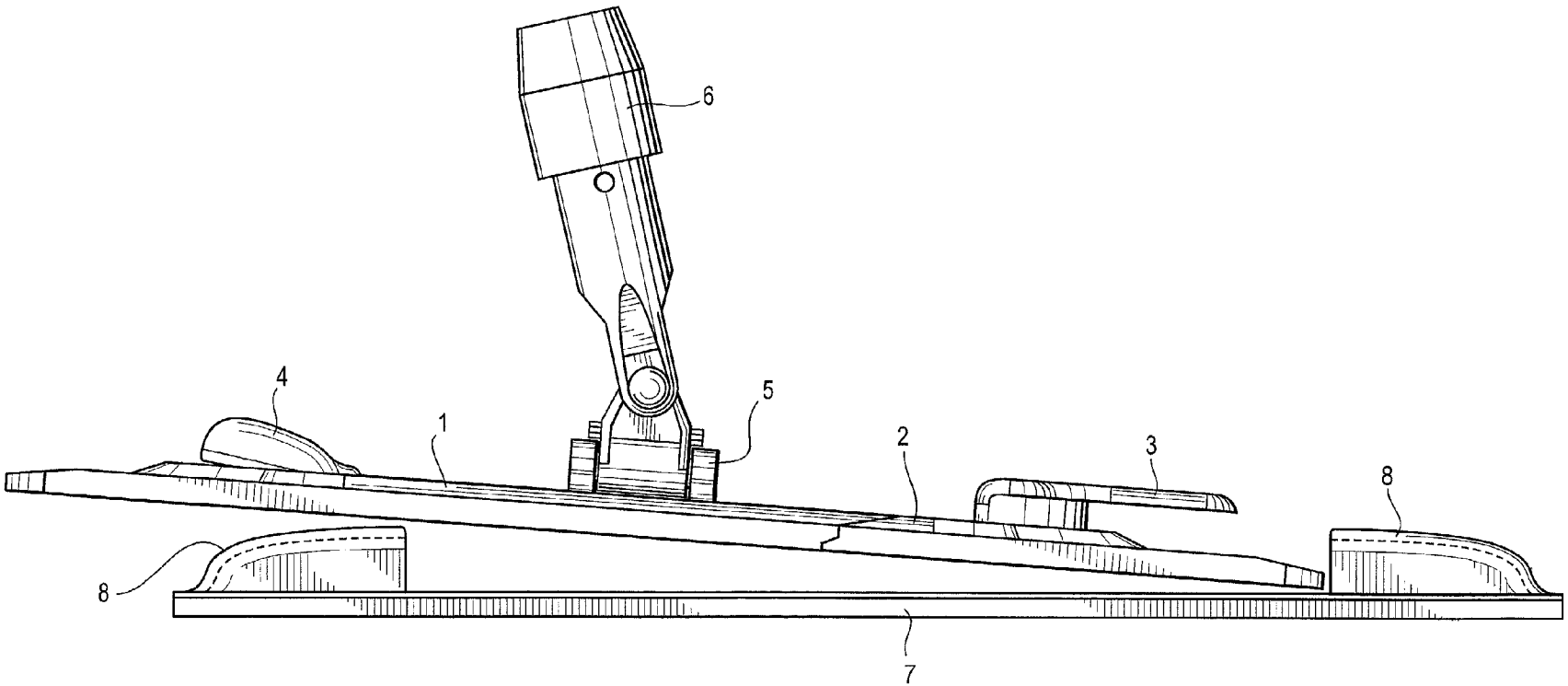
FIG. 6 shows the beginning of a process for inserting a mop base according to FIG. 1 with one end into a pocket of a mop pad according to FIG. 4 and FIG. 5
Figure 7:
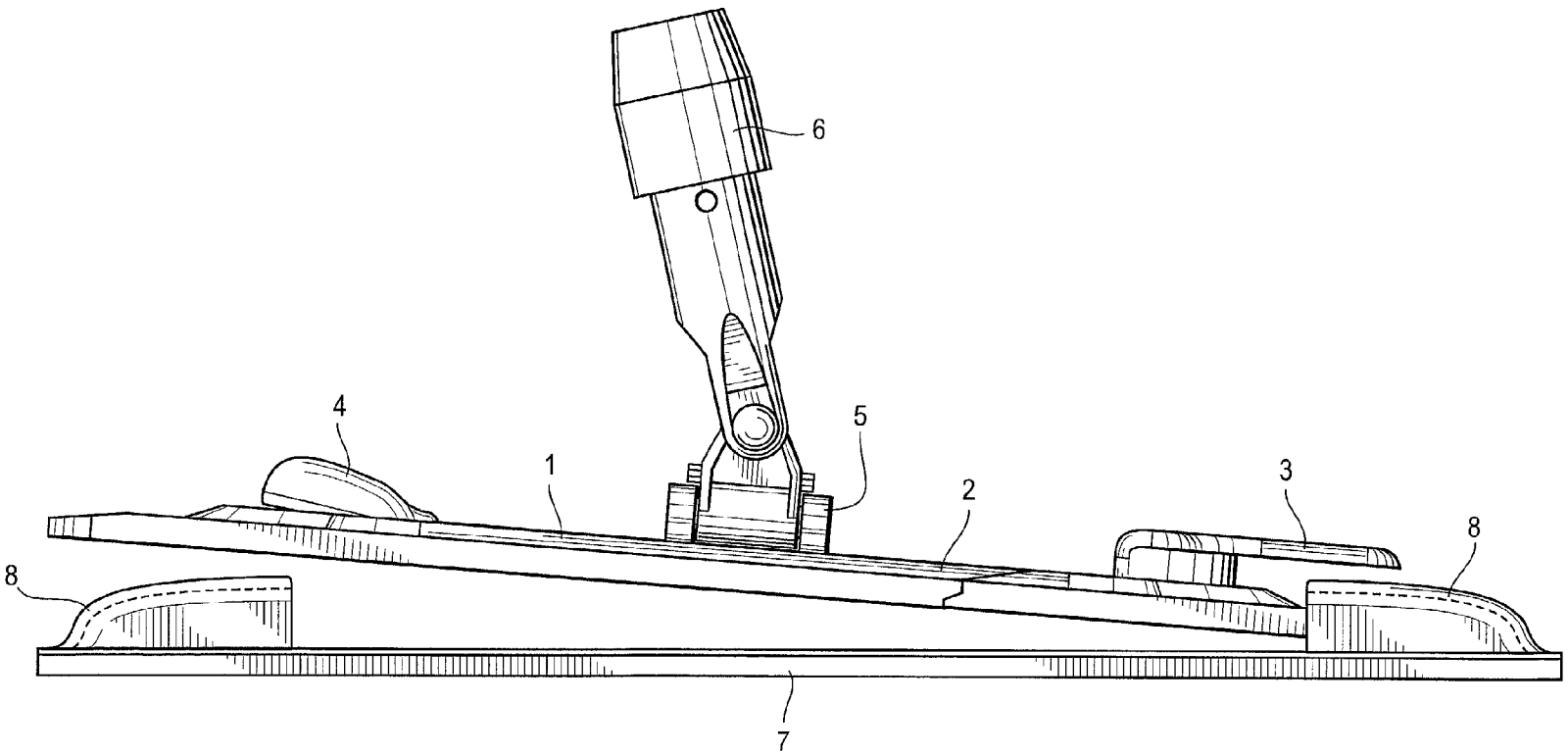
FIG. 7 shows the pocketing process of FIG. 6 completed.
Figure 8:
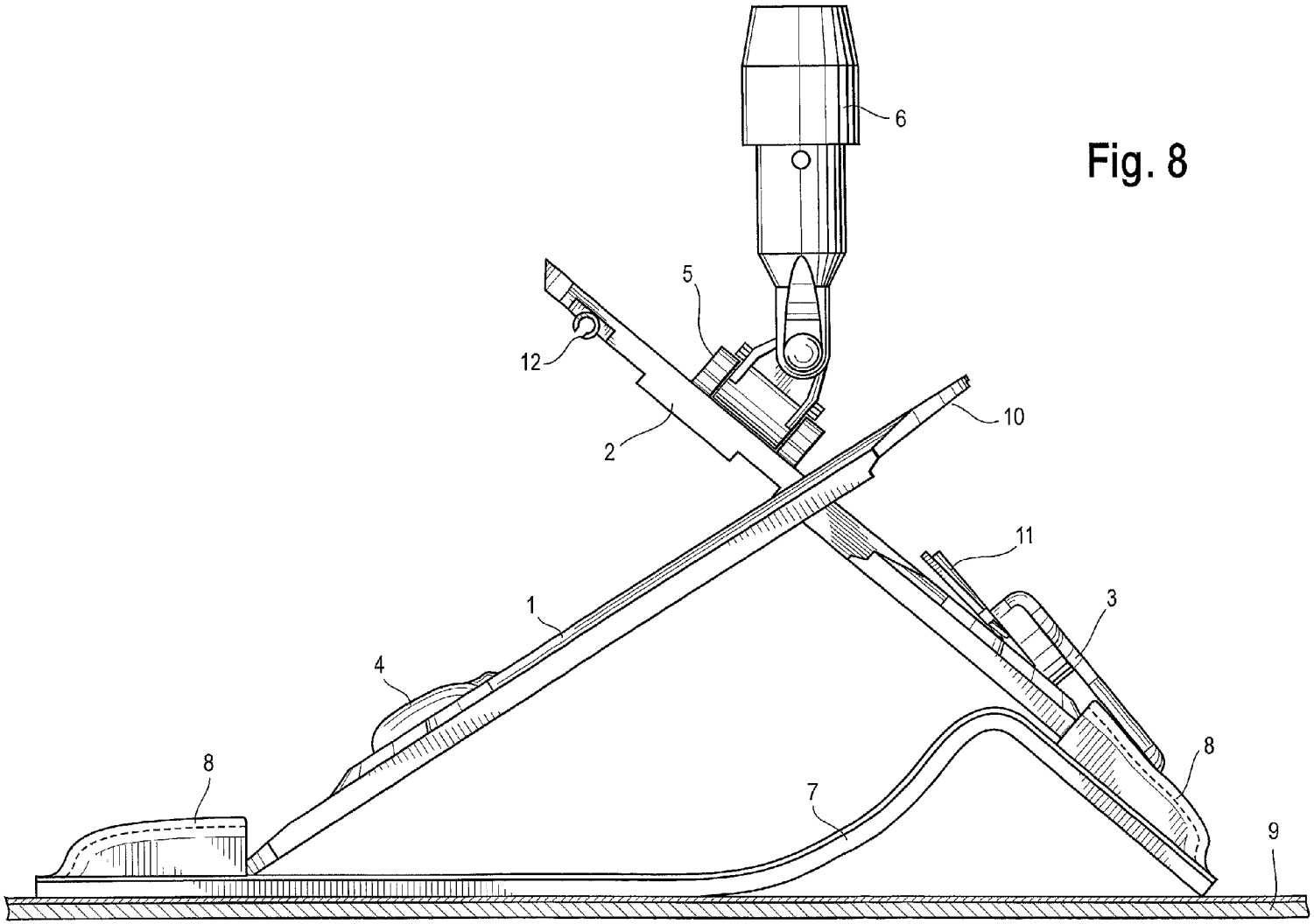
FIG. 8 shows a mop base according to a first embodiment of the present invention with the latch mechanism released for pocketing the second end of the mop base in the mop pad.

By using a mop base 100 according to the present invention, the assembly and disassembly of a mop according to the present invention are carried out as will be described:

The mop pad 7 with pockets 8 is stretched on the floor:

- the mop base 100 places itself in planar position so that the clamping device 3 is with its mouth open as illustrated in FIG. 2;
- the mop base 100 is placed with its end provided with the clamping device near one of the pocket 8 as shown in FIG. 6;
- the end of the mop base 100 is inserted in the opposite pocket 8 of the mop pad 7 as shown in FIG. 7, a clamping device 3 does not present any obstacle being its mouth open;
- the latch 4, which is on the surface of the mop base 100, is pressed with the foot in order to deactivate the block nib 12; the mop base 100 places itself to take the angled shape, and simultaneously a clamping device 3, whose arm is not stretched by the extension 10 of the opposed arm anymore, clamps the pocket's 8 outside wall as shown in FIG. 8;

the handle 6 is raised so that the end of the mop base 100, without a clamping device 3, places itself in the mop pads 7 central free piece;

the handle 6 linked to the mop base 100 is lowered so that the end of the mop base 100 arm, which is without a clamping device 3, is inserted in the other mop pads 7 available pocket 8;

the lowering of the handle 6 against the floor 9 is completed so as to get the mop base 100 be planar (and when it is necessary, giving help to the lowering of the handle 6, you can press on the suitable rise on the mop base 100 surface).

Figure 9:
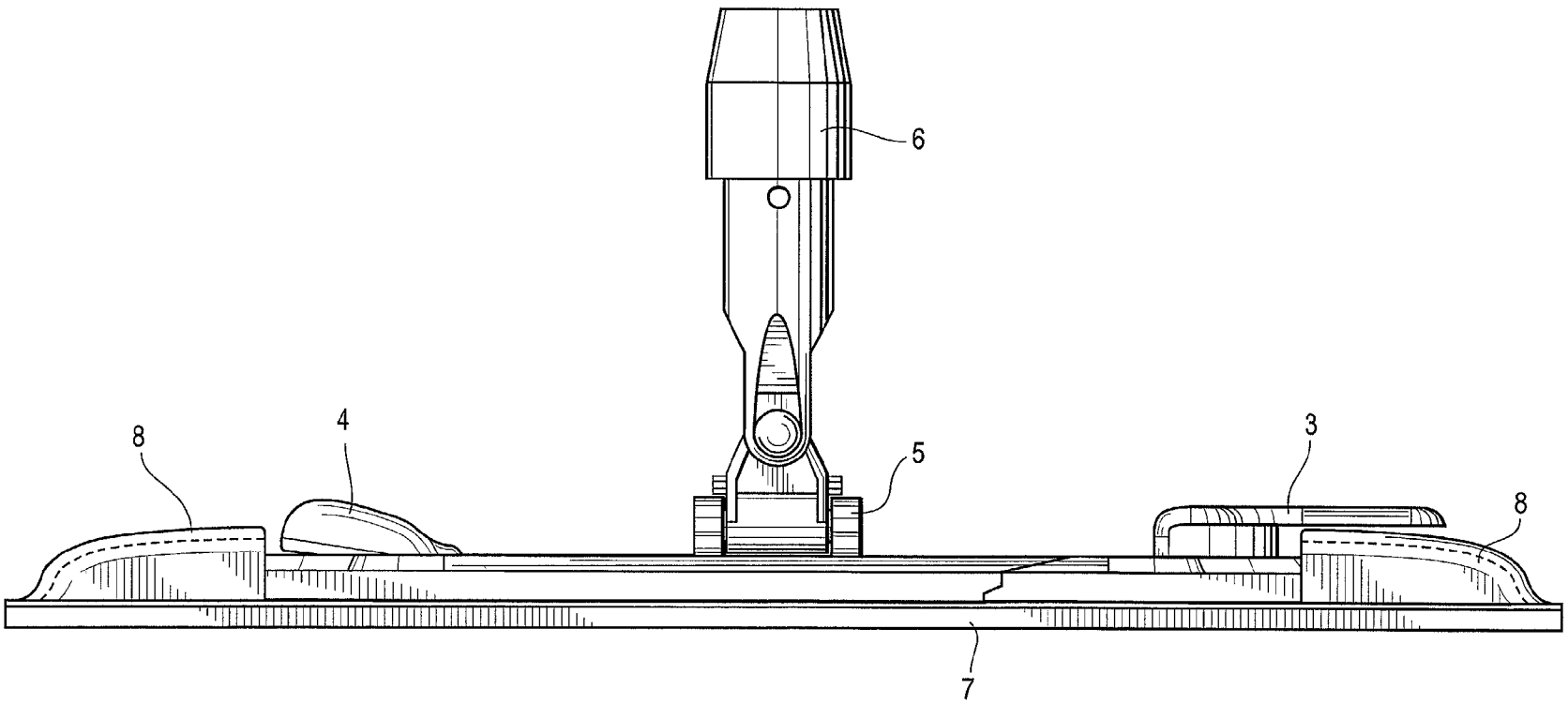
FIG. 9 shows a mop ready for use with a mop base according to a first embodiment of the present invention completely inserted into the pockets of a mop pad.

The combination mop pad 7 and mop base 100 shown in FIG. 9 is carried out by the simultaneous stretching of the mop pad, being open at the same time the mouth of the clamping device whose lever arm 11, opposed to the mouth, is now pressed by the extension 10 of the mop base 100 opposed arm.

The broom with a mop base 100 according to the present invention and a mop pad 7 with pockets 8 is available for use.

When the cycle of disinfecting is concluded, the mop pad 7 needs to be replaced. To get such result, the following phases are necessary:

with the mop pad 7 and the above mop base 100 basing on the floor 9, it is to be acted on the latch 4 on the mop base 100 in order to deactivate the block nib;

the mop base 100 places itself to take the angled shape and the clamping device, whose opposed lever arm 11 is not pressed anymore, (by the extension of the mop base 100 opposed arm) closes itself for clamping a pocket's 8 wall of the mop pad 7.

Figure 10:
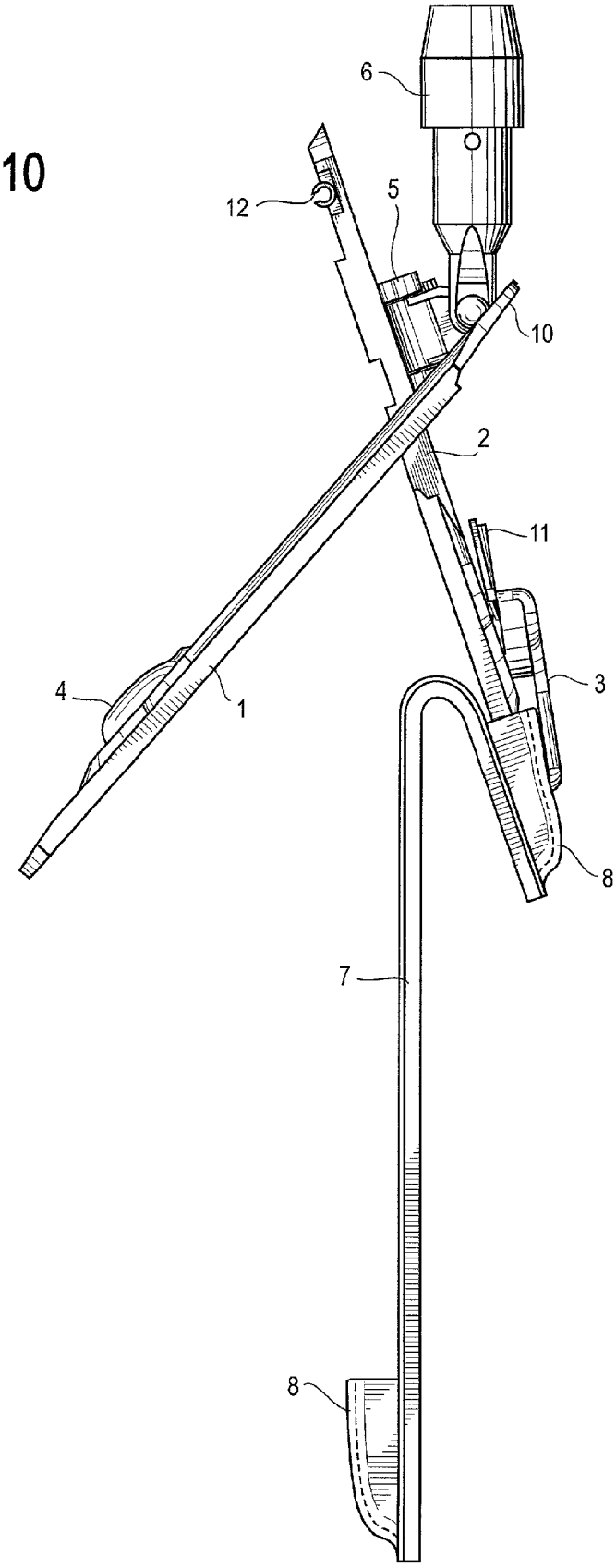
FIG. 10 shows a mop according to a first embodiment of the present invention in a state ready for removing the mop pad.

The handle 6 is raised with the mop base 100 till at the level of the operator's waist; simultaneously one raises the mop pad 7, which is hanging down because it is hold by the clamping device 3 as shown in FIG. 10. Without bending, the operator takes up the mop pad 7 making it go out from the clamping device 3 hold. He or she carries it to be washed or places it in the case to be washed by washing machines together with other mop pads previously used.

For the application of a clean or of another different type of mop pad, one has to operate as it was previously described, without the operator's need to bend. In this way he or she carries out all the phases of assembly or disassembly of the mop staying in straight position.

What is described above is intended only by way of example according to a preferred solution. There is another solution which is not described above but it is valid all the same and is represented in the enclosed drawings. It is obtained by combining the clamping device 3, which constitutes the peculiarity of the patent, in the latch 4.

With the mop base 100 (above mentioned) in angled position, the mouth of the clamping device 3 is closed because of an action of a spring 14 which keeps the lever arm 11 raised; this lever arm 11 is opposed to another one constituting the mobile part of the clamping device' 3 mouth.

With the mop base 100 in planar position, the mouth of the clamping device 3 is open because of an action of the mop base 100 opposed part's extension 10 which acts on the lever arm 11 of the clamping device 3; the extension 10 lowers the lever arm 11 counteracting the spring 14 which kept the lever arm 11 raised.

From what has just been described it comes out that in order to carry out the combination of the mop base 100 with the pockets mop pad 7 by the clamping device 3, the operator has to carry out two manoeuvres in addition to the usual combination of the mop base 100 with the pockets mop pad 7 without the clamping device 7. More specifically, the first manoeuvre of inserting the mop base 100 with its mouth open in one pocket 8 of the mop pad 7 can be difficult since he or she has to keep the mop pad 7 laid out on the floor 9.

Figure 11:
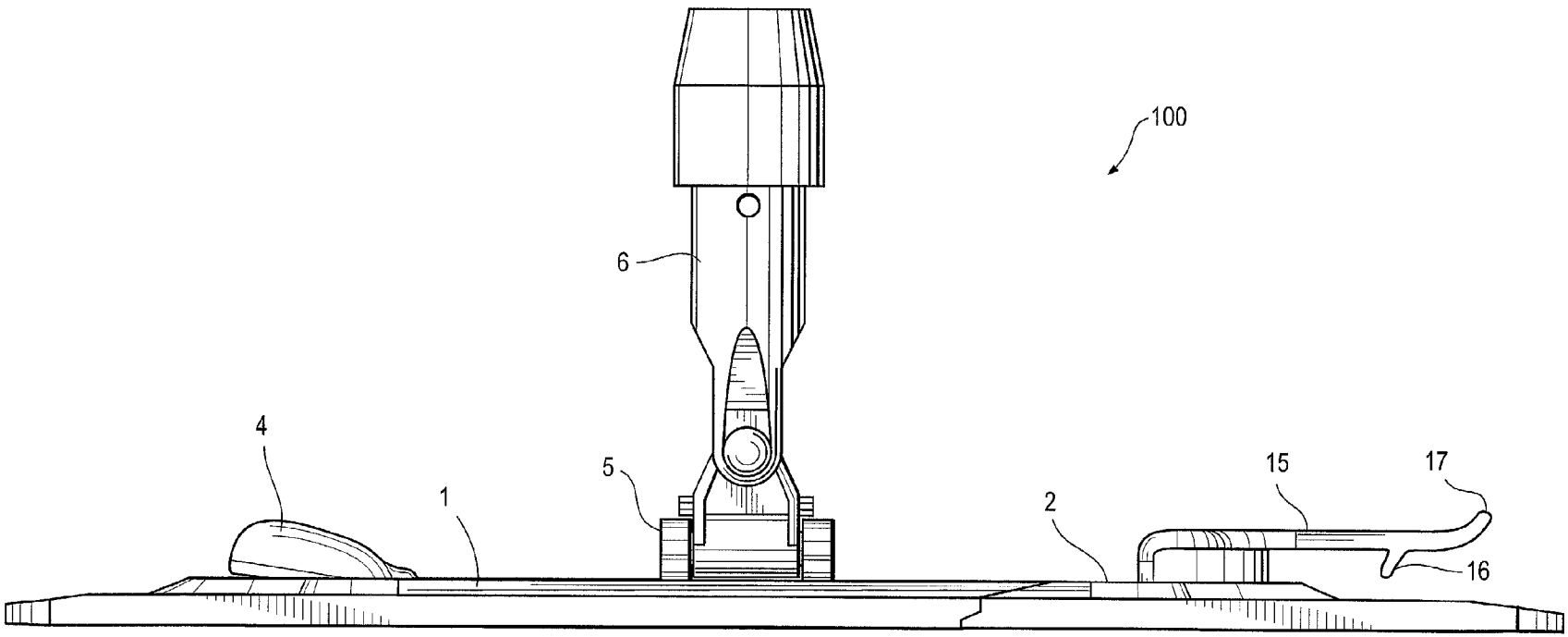
FIG. 11 shows a side view of a second embodiment of a mop base according to the present invention.

On the contrary, the first aim of a second embodiment shown in FIG. 11 is to avoid the first manoeuvres, working, as it occurs, in the usual combinations of the mop base without either clamping device 3 or pockets mop pad 7.

In order to avoid the starting manoeuvres previously described and to act as it happens in the usual combinations of mop bases without a clamping device for a pocket mop pad, a different shape of the mobile part (the clamping device) has been provided.

The innovation is in the fact that the mobile part of the clamping device' 3 mouth is shaped with its border 17 raised so that when the clamping device 3 is closed the mouth shows itself at the beginning in front of the border of the mop's pocket 8 as if the clamping device 3 was open. The base of the clamping device' 3 mouth on the lower level of the mop base 100 which supports it is achieved by a prominent rise 16 which is removed from the lower inner surface of the mouth's mobile part 15. This rise 16 is inclined in the same direction of the advance of the pocket's 8 border during the insertion phase.

Figure 12:
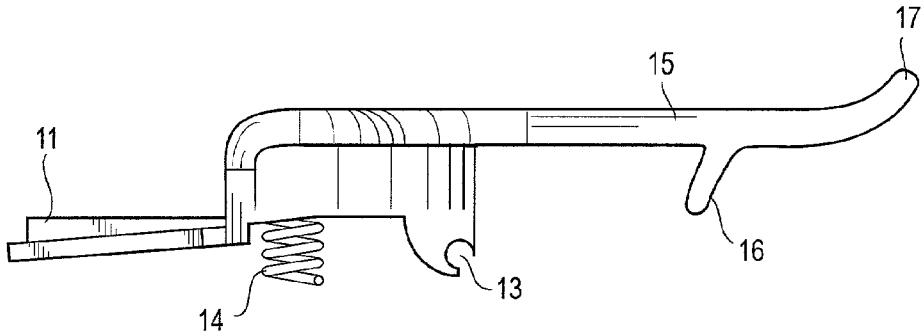
FIG. 12 shows a detail of a clamping fixture according to a second embodiment of the present invention.

A first type of a clamping device 3 used for a second embodiment of the present invention described above is shown in FIG. 12. Like the clamping device 3 used for the first embodiment of the present invention, it comprises a clam like snap on projection 13 formed at its lower central part for providing a tilt axis when being snapped on an appropriately formed feature on the board of element 2. It further comprises a lever like arm 15 which extends in the direction of the free end of the first element 2 when the clamping device 3 is mounted. A lever 11 is provided at the end opposite the lever like arm 15. A compression spring 14 biases the tilt position of the clamping device 3 when no force is exerted to the lever 11 such, that the lever like arm tilts to the top surface of the first element. Different from the first embodiment of the clamping device 3, a dent like structure 16 protrudes from the surface of the lever like arm 15 which faces the top surface of element 2 when the clamping device 3 is mounted to it. The protrusion 16 or rise 16, respectively, limits a tilting of the clamping device towards the top surface of element 2 preventing it from being touched by the raised front boarder 17 of the lever like arm 15. Thus, the clamping device provides a mouth for trapping a pocket 8 of a mop pad 7 even when the respective clamping fixture is closed, by simultaneously clamping the pocket 8 as soon as it is pushed under the rise 16. The inclination of the rise 16 with its free end towards the tilt axis of the clamping device enables a pocket 8 of a mop pad 7 to be pushed underneath the rise 16 without any need for opening the clamping fixture defined by the clamping device of FIG. 12 and the top surface of element 2.

Figure 13:
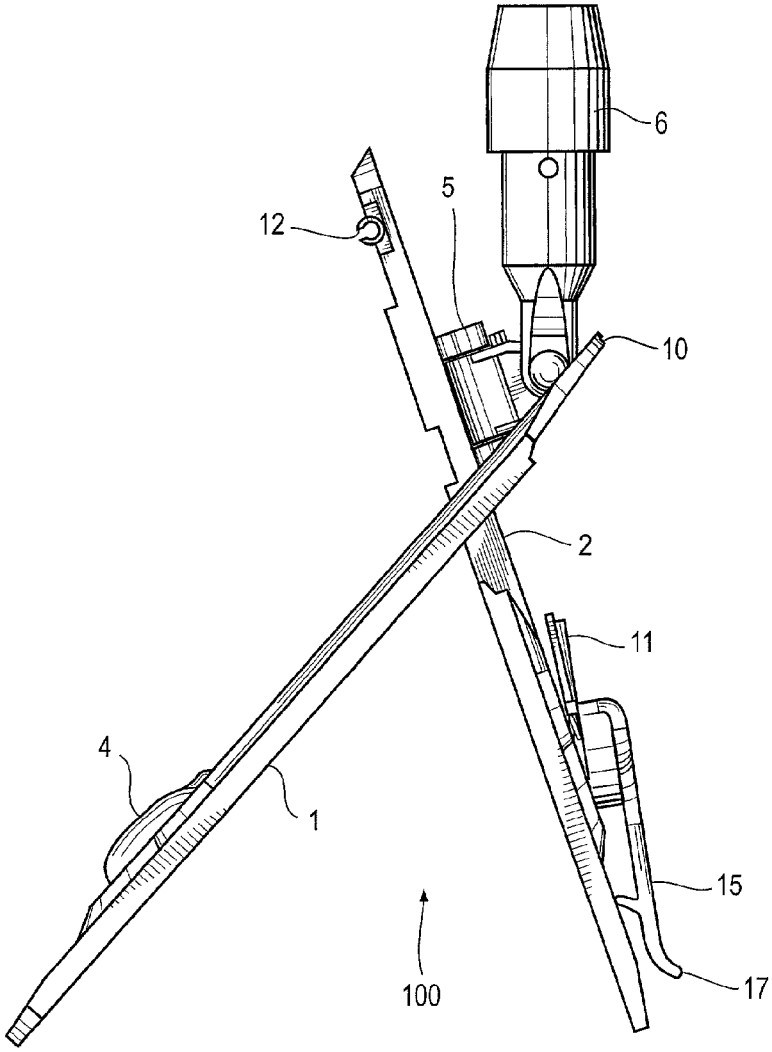
FIG. 13 shows a mop base according to a second embodiment of the present invention with the latch mechanism released.

The first manoeuvre of the combination of the mop base 100 and pockets mop pad 7 is carried out as usual with the mop base 100 in angled shape as shown in FIG. 13. The clamping device (11, 15, 16, 17) is hereby tilted towards the top surface of element 2. As shown, the rise 16 of the clamping device does not necessarily have to be in contact with element 2 as long as the gap between both elements is small enough for enabling a sufficient clamping force.

Figure 14:
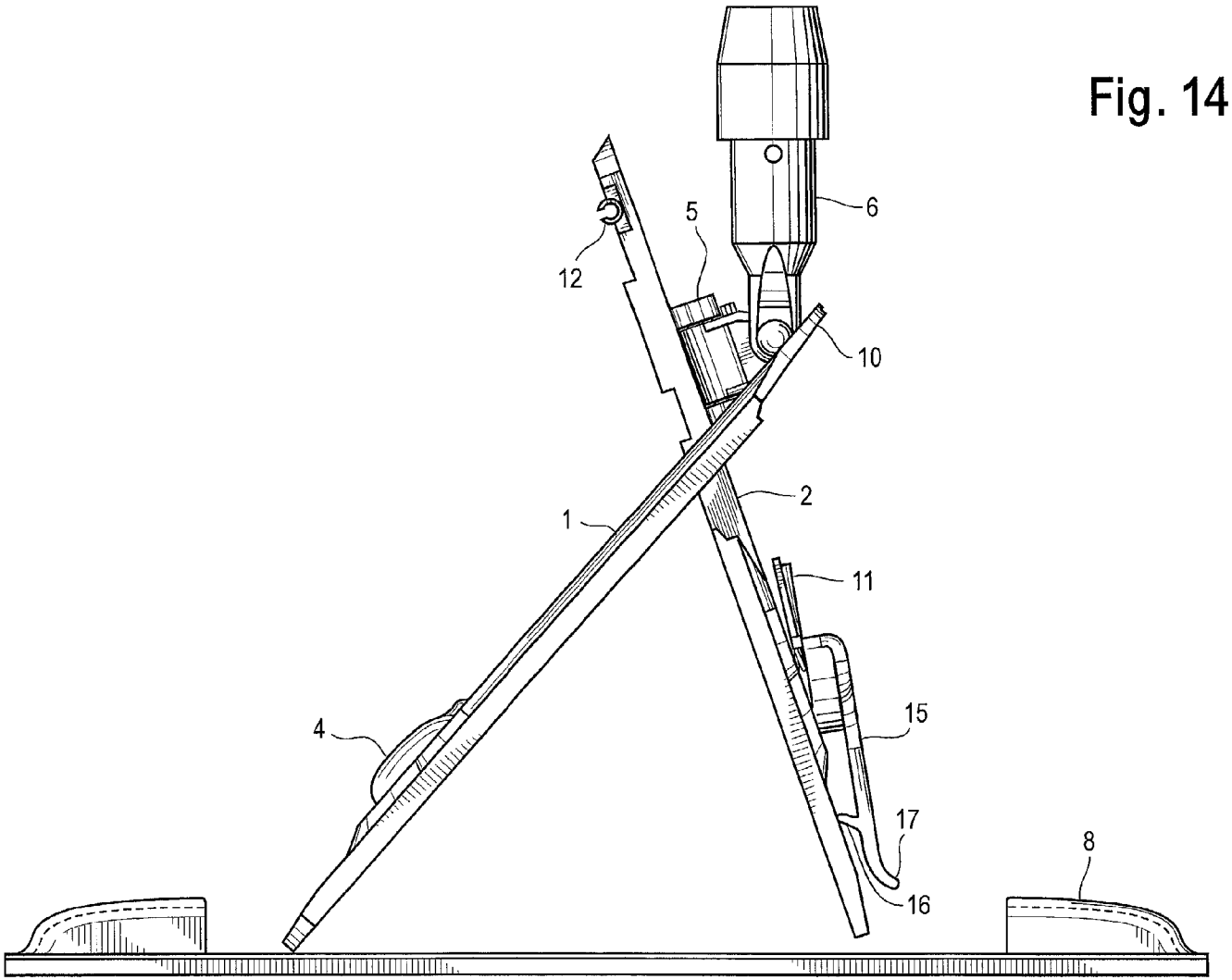
FIG. 14 shows the beginning of the process for putting a mop pad with pockets on a mop base according to a second embodiment of the present invention.

Next as shown in FIG. 14, the mop base 100 is placed in angled shape on a pockets mop pad 7 as it usually happens when a mop base 100 is not supplied with a clamping device.

By pushing the handle 6 downwards, the mop base 100 tends to take the planar shape. The mop base's end without the clamping device 3 is inserted in the mop pad's facing pocket 8 almost completely; the other end, which has the clamping device (11, 15, 16, 17), is inserted in the relevant facing pocket 8 starting the stretching action. The border of the mop pad's pocket 8, which is on the clamping device' side, when surpassed the mouth's raised part 17, meets the rise inclined forcibly.

At the same time, the extension of the mop base's part opposed to the one with the clamping device 3, which surpasses the tilt axis, comes to cross the lever arm 11 of the clamping device' (11, 15, 16, 17) opposed to the mouth and makes it be open.

Figure 15:
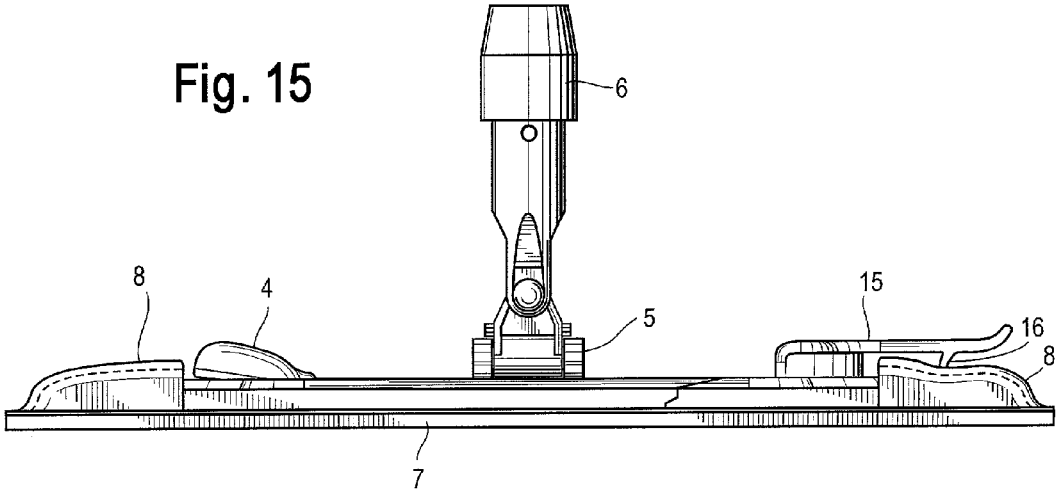
FIG. 15 shows a mop ready for use with a mop base according to a second embodiment of the present invention completely inserted into the pockets of a mop pad.
Figure 16:
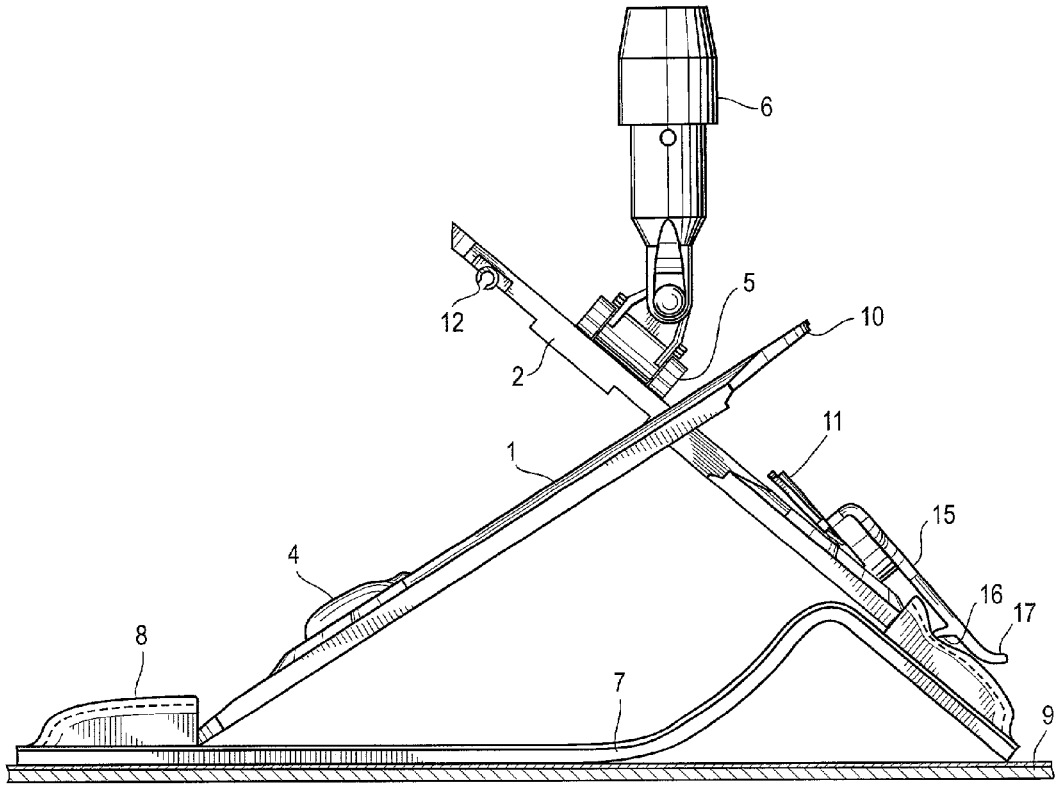
FIG. 16 shows the beginning of the process for removing a mop pad from a mop base according to a second embodiment of the present invention.

The mop base 100 places itself in planar conditions and the mop pad 7, when surpassed the inclined rise 16, concludes its stretching illustrated in FIG. 15.

Figure 17:
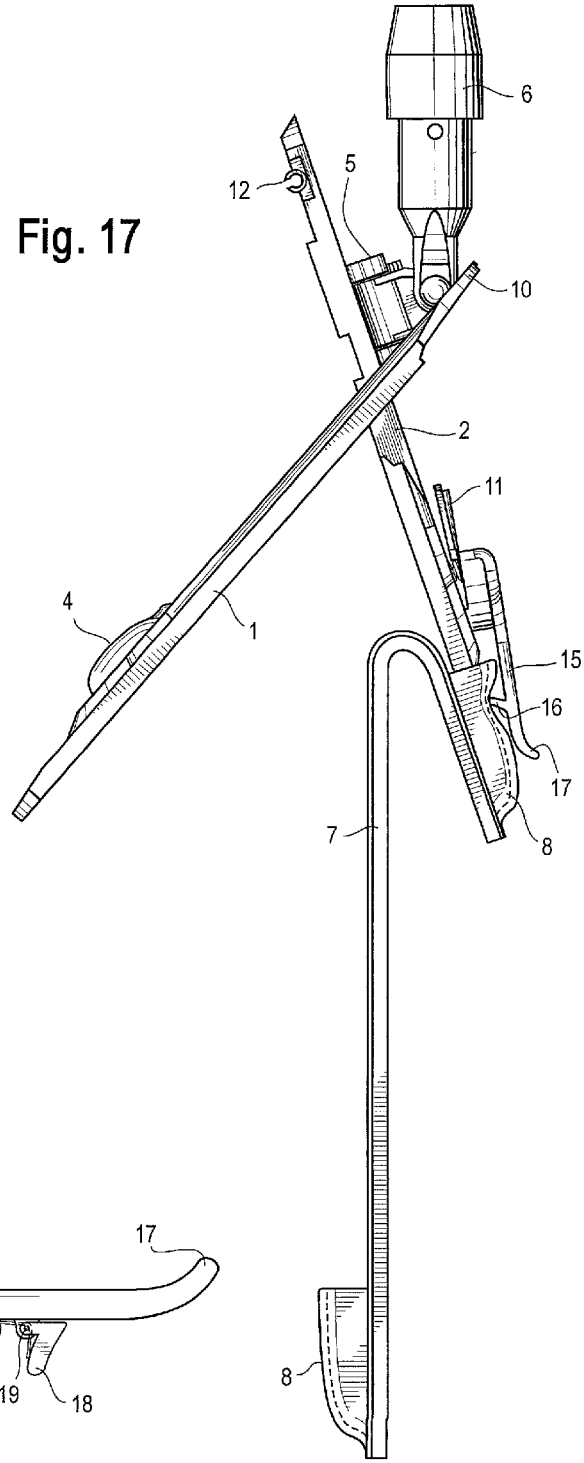
FIG. 17 shows a mop according to a second embodiment of the present invention in a state for removing the mop pad.

For replacing the mop pad 7, the latch 4 is pressed to unlock the mop base 100. The mop base takes in an angled shape and one end of the mop pad slips from element 1 as soon as the handle is raised to lift the mop base 100 from the floor. The other end of the mop pad 7 is clamped by the clamping device (11, 15, 16, 17) so that it cannot slip off the mop base as shown in FIG. 17. Without bending, the operator takes up the mop pad 7 making it go out from the clamping device hold by simply pulling it off.

All the manoeuvres and the following movements are carried out as described above for a clamping device described above with reference to FIG. 12.

As it has just been described, this embodiment's first aim can be achieved also by carrying out a different structure of the mop base 100; that is to say by avoiding the integral extension 10 with the part of the mop base 100 which is opposed to the other one with the clamping device and by carrying out a clamping device which is always in closing position and is stressed or no by a flexible means. The aforesaid clamping device shows the mouth's front border 17 raised with a curvilinear progress and on the inner surface it shows an inside supporting rise 18 rather spaced out from the raised border 17 and inclined towards the way in of the border of the mop pad's pocket 8; the rise 18 is jointed 19 (or pliable) only towards the way in of the border of the mop pad's pocket.

Figure 18:
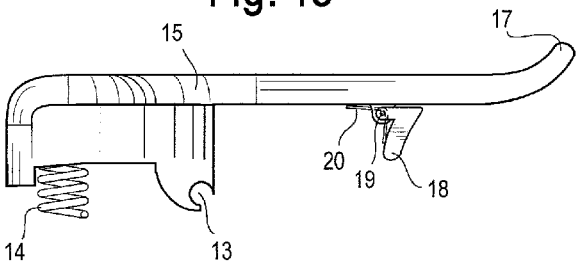
FIG. 18 shows an alternative embodiment for a clamping fixture according to a second embodiment of the present invention.

FIG. 18 gives a detailed illustration of this modified form of a clamping device. The modification is characterised by the rise 16 being replaced by a dent like element 18. The dent like structure 18 is pivotally attached to an axle 19 provided on the surface of the lever like arm 15, which is duly oriented to the top surface of element 2. A return spring 20 keeps the dent like structure 18 in the resting position shown in FIG. 18. When an end of a mop base 100 with this modified form of a clamping device is inserted into a pocket 8 of a mop pad 7, the seam or boarder, respectively, of the pocket is pushed against the dent like structure 18 turning it inwards toward the tilt axis 13. With the mop base 100 being completely inserted in the pocket 8, the return spring repositions the dent like structure 18 in its starting position.

The invention claimed is:

1. A mop base for a mop pad with first and second pockets, the mop base comprising:

a first element having a first free end, the first free end adapted to fit within the first pocket of the mop pad;

a second element pivotally connected to the first element, the second element having a second free end, the second free end adapted to fit within the second pocket of the mop pad;

a pivot joint that provides a rotation axis for relative rotation of the first element with respect to the second element, to change the configuration of the mop base between a planar first state, in which the first element and the second element are substantially coplanar, and an angled second state, in which the first element and the second element are in an angled configuration; and a clamping device disposed on the first element, the clamping device having a mouth like opening and arranged such that the mouth like opening is adapted to close and thereby clamp a pocket wall of the first pocket of the mop pad when the mop base is in the angled second state.

2. The mop base of claim 1, further including a latch adapted to releasably secure the mop base in the planar first state.

3. The mop base of claim 2, wherein the latch is disposed on the second element.

4. The mop base of claim 1, wherein the mouth like opening of the clamping device is open when the mop base is in the planar first state.

5. The mop base of claim 4, wherein the clamping device includes a lever and the second element includes an extension that overlays the lever when the mop base is in the planar first state.

6. The mop base of claim 1, wherein the mouth like opening is biased to a closed position.

7. The mop base of claim 6, wherein the bias is supplied by a spring.

8. The mop base of claim 7, wherein the clamping device includes a lever and wherein the spring is positioned between the lever and the first element.

9. The mop base of claim 6, wherein the bias is strong enough to hold a mop pad suspended under its own weight and weak enough to allow a user to readily pull the mop pad off of the first free end of the first element.

10. The mop base of claim 1, wherein the mouth like opening has a curvilinear shape in which a free end of the mouth like opening curves away from the first element.

11. The mop base of claim 1, wherein the mouth like opening has an appendage projecting toward the first element.

12. The mop base of claim 11, wherein the appendage projects at an angle from the mouth like opening.

13. The mop base of claim 11, wherein the appendage is flexible.

14. The mop base of claim 1, further including a latch mechanism adapted to releasably secure the first and second elements in a substantially coplanar condition in the planar first configuration.

15. The mop base of claim 14, wherein the latch mechanism includes a pair of clips.

16. The mop base of clam 1, wherein one of the first and second elements is connected to a first end of a link and wherein a mop handle is connected to a second end of the link.

17. The mop base of claim 16, wherein the link comprises two axes of rotation arranged substantially perpendicular to one another.

* * * * *